US006820387B2

(12) United States Patent
Sacks et al.

(10) Patent No.: US 6,820,387 B2
(45) Date of Patent: Nov. 23, 2004

(54) SELF-STIFFENED WELDED WIRE LATH ASSEMBLY

(76) Inventors: Abraham Sacks, 1516 Westbrook Crescent, Vancouver, British Columbia (CA), V6T 1V8; Jeffrey L. Sacks, 644 West 20th Avenue, Vancouver, British Columbia (CA), V6H 1Y1; William Spilchen, 15173 Royal Avenue, White Rock, British Columbia (CA), V4B 1M2; Narcis Rugina, 7543 - 10th Avenue, New Westminster, British Columbia (CA), V3N 2S1; Harold R. Davis, 4065 West 13th Avenue, Vancouver, British Columbia (CA), V6R 2T3

( * ) Notice: Subject to any disclaimer, the term of this patent is extended or adjusted under 35 U.S.C. 154(b) by 0 days.

(21) Appl. No.: 09/927,544

(22) Filed: Aug. 13, 2001

(65) Prior Publication Data

US 2003/0029120 A1 Feb. 13, 2003

(51) Int. Cl.[7] ..... E04C 5/04

(52) U.S. Cl. ..... 52/660; 52/664; 52/322; 52/337; 52/348; 52/355; 52/361; 52/362; 52/363

(58) Field of Search ..... 52/660, 664, 348, 52/355, 337, 633, 637, 661, 663, 319, 665–676, 648.1, 344, 350–351, 342, 361–363, 322, 390.1

(56) References Cited

U.S. PATENT DOCUMENTS

| | | | | | |
|---|---|---|---|---|---|
| 617,458 | A | * | 1/1899 | Clancey | 52/660 |
| 4,003,178 | A | * | 1/1977 | Douthwaite | 52/664 |
| 4,539,787 | A | * | 9/1985 | Ritter et al. | 52/664 |
| 4,819,395 | A | * | 4/1989 | Sugita et al. | 52/309.16 |
| 5,527,590 | A | * | 6/1996 | Priluck | 428/198 |
| 5,540,023 | A | * | 7/1996 | Jaenson | 52/343 |
| 6,263,629 | B1 | * | 7/2001 | Brown, Jr. | 52/309.16 |
| 6,305,432 | B1 | * | 10/2001 | Sacks et al. | 139/425 R |

FOREIGN PATENT DOCUMENTS

| | | | |
|---|---|---|---|
| CH | 658489 | * | 12/1952 |
| DE | 4019281 | * | 12/1991 |
| EP | 579 007 | * | 6/1993 |
| EP | 637658 | * | 2/1995 |
| JP | 03132322 | | 10/1992 |
| JP | 06047691 | | 9/1995 |
| JP | 09347789 | | 7/1999 |
| JP | 11244330 | | 3/2001 |
| WO | WO9713936 | | 4/1997 |

* cited by examiner

*Primary Examiner*—Jeanette Chapman

(57) ABSTRACT

A self-furring wire lath has stiffening trusses. In a preferred embodiment the lath comprises a grid of intersecting transverse and longitudinal wires welded at their intersections. Stiffening trusses are formed at bent sections in the transverse wires by first longitudinal wires affixed at the shoulders of the bent sections and second longitudinal wires affixed on the bent sections. A barrier layer is disposed between the first and second longitudinal wires. A building paper backing may be affixed to the barrier layer. The lath reduces cracking and wastage of stucco while remaining easy to work with.

3 Claims, 4 Drawing Sheets

SELF-STIFFENED WELDED WIRE LATH ASSEMBLY

TECHNICAL FIELD

This invention relates to building technology, and in particular to wire lath which may be used to reinforce coatings, such as stucco, applied to soffits and other building surfaces.

BACKGROUND

Some building construction techniques involve the application of a coating, such as stucco, to a surface. The coating may be desired, for example, to improve appearance, enhance fire resistance or to comply with building or fire codes. In the following disclosure the term "stucco" is used generally to apply to cementitious plasters or gypsum plasters, including stuccos as defined in applicable building codes.

When applying a coating of stucco (or other similar material) it is generally desirable to provide a lath on the surface. The lath provides reinforcing for the stucco and holds the stucco in place while it cures. Difficulties can be encountered in applying stucco to overhanging surfaces such as soffits (i.e. the area under building eaves) and the undersides of exposed roof areas, such as porticos. In such areas gravity tends to cause the stucco to sag after it has been applied.

The framing for soffits is typically open. Framing members typically extend transversely across the soffit opening at regular spacings (for example, 16 inches or 24 inches center-to-center). A lath is applied across the opening and attached to the framing members. Stucco is then applied to the lath. The lath supports the stucco and, after the stucco dries, reinforces the stucco. Stucco may be applied in various ways including by hand trowel, or by spraying onto the lath. In either case significant pressures can be imposed on the lath.

The lath must meet several requirements. First, it must be rigid enough to withstand the stresses of the stucco being applied. If the lath is deflected significantly during installation, then stucco in areas adjacent to the deflected area will be disturbed and will likely fall out. Second, the lath must provide adequate reinforcement so that the stucco coating on the soffit will be able to withstand maximum expected wind pressures. The lath should have features which provide good keying and embedment of the stucco over the entire area of the lath. Third, the lath should be designed in such a way as to assist in making the layer of stucco even in thickness. A stucco layer which is uneven in thickness can be prone to cracking.

In many applications it is desirable to have a backing membrane integrated with the lath. A backing membrane prevents stucco from blowing through the lath. Such a membrane is especially desirable in applications where stucco will be pumped or sprayed onto the lath.

Various types of lath have been developed for soffit applications. Specialty expanded metal laths are very widely used. Such laths have been produced by companies such as Alabama Metal Industries Corporation of Birmingham, Ala. under the trade-mark AMIC™. AMICO's expanded metal lath products currently include:

- ⅛" Rib Lath ("Flat Rib"). This lath has eighteen ribs approximately ⅛ inch high, spaced 1½ inches on center to provide rigidity for horizontal applications. The lath has a large number of openings or "keys" which provide keying for either troweled or machine-applied stucco.
- ⅜" Rib Lath ("High Rib"). This lath has seven longitudinal ribs, each ⅜ inch deep and eight small flat ribs to provide additional rigidity for horizontal applications. A herringbone mesh is located between the ribs to provide keys for good bonding of the stucco to the lath.
- Cal Spray Rib ("⅛ Inch Flat Rib"). This is a more rigid lath which includes strips of kraft paper attached between the ribs. The added rigidity makes this product well suited for horizontal applications, such as soffits. The paper helps reduce the amount of plaster waste and is not intended to be moisture resistant. A version of Cal Spray Rib having ⅜ inch high ribs is also available. Similar products have been available from California Expanded Metals Company (CEMCO™) and others.

Expanded metal lath products such as those described above can provide good rigidity and stiffness for their rated spans. They also provide good keying and hang on surfaces. However, these products have some disadvantages. First, at the locations of the stiffening ribs, the stucco is much thinner than it is at other locations. Furthermore, the ribs present unbroken surfaces which do not provide opportunity for embedment and keying of stucco. This typically results in a series of cracks forming along each of the ribs.

Another disadvantage of prior expanded metal lath systems is that the keys are typically quite small. Correct installation practice requires the edges of adjacent sheets of lath to be overlapped. However, with small key openings it is typically impossible to force stucco adequately through the lath in the overlapping portions. This results in a weak zone in which the stucco is likely to crack at each point where sheets of the lath overlap.

A third difficulty with expanded metal lath is that it is difficult to cut, especially if the ribs are high. When cut, expanded metal lath typically exhibits razor sharp edges. This makes current expanded metal lath products tedious and even dangerous to install.

Another group of stucco laths sometimes used for soffits are wire fabric laths. Wire fabric laths typically comprise a rectangular mesh of wires which are welded at their intersections. Wire fabric laths have been available, for example, from the Georgetown Wire Company, Inc, of Fontana, Calif. under the trademark K-LATH™. Some examples of such laths include:

- Stucco-Rite™ standard. This product is a self-furring sheet of galvanized welded-wire-fabric lath, 16 gauge by 16 gauge, with 2 inch by 2 inch openings. A perforated absorbent carrier kraft paper is incorporated into the mesh, and a Grade D water proofed breather building paper is laminated to the back side of the kraft paper. A heavy duty version features an 11 gauge stiffener wire every 6 inches.
- Standard "Gun Lath". This is a flat sheet welded wire lath, with 2 inch by 2 inch openings, 16 gauge by 16 gauge with a 13 gauge stiffener wire every 4 inches along length of the sheet. An absorbent, slot perforated kraft paper sheet is incorporated between the face and back wires. A heavy duty version features an 11 gauge stiffener wire every 6 inches on center.
- "Soffit Lath". This product is similar to Gun Lath with 16 gauge by 16 gauge wires, but with grid spacing at 1.5 inches by 2 inches. The backing kraft paper has smaller perforated openings which are to provide a more positive keying for the soffit stucco.

Wire fabric laths are more worker friendly than the expanded metal laths in that they are easy to cut, and do not present as many sharp edges when cut. They are also easy to overlap without blinding the openings at the overlap areas. This reduces cracking at overlaps of sheets. Further, there are no stiffening ribs that can cause cracking. Therefore, the overall finished stucco is much better since cracking is minimized.

However, current paper-backed wire laths have two major disadvantages. First, the relatively large wire grid spacing provides little hang on surface area for the wet stucco to hang onto. The perforated backing kraft papers do prevent blow through, but do not have sufficient keying or suction capability to hang onto the wet stucco.

A second disadvantage of current wire lath products is that they are not as rigid as is desirable. These laths tend to deflect as the plasterer applies force. After the force is removed the lath springs back. As this happens fresh plaster in adjoining areas can be dislodged and fall out. This exacerbates the stucco fall out problem. Therefore, plasterers must apply stucco to wire lath very carefully. This is a major disadvantage since it slows down speed of application. Even so, there is typically a high wastage of stucco.

Rigidity can be increased somewhat by using larger diameter wires. However, increase in wire diameter does very little to increase stiffness. If wire diameters are increased enough to provide significant increases in rigidity then the large wires close to the stucco surface tend to cause the stucco to crack along the large wires.

A third disadvantage of some current paper backed wire laths is that the installed stucco plaster has uneven thickness which results in additional cracking of the stucco. This problem is exacerbated because the paper is tightly attached to the wire lath itself. This prevents the stucco from totally surrounding the wires of the lath. As a result the attachment of the stucco to the lath is weaker than would be desired and the stucco can separate from the lath under certain loading conditions.

Jaenson, U.S. Pat. No. 5,540,023 discloses an improved wire lath in which a layer of backing paper is held in place between two courses of horizontal wires. The backing paper is not tightly attached to the lath and allows good keying. However, this wire lath requires that the welds of the lath be made through perforated holes in the backing paper. The backing paper must have a hole at each intersection between two wires. This is a disadvantage for producing laths with smaller grid spacings, since the amount of hole area required becomes very large, leaving less and less paper area. This is a major disadvantage for soffit applications since increasing the hole area results in increased blow-through. Further the kraft paper could easily tear between holes resulting in even more blow-through.

Japanese patent application No. 06047691 published on Sep. 9, 1995 (JP 07233611A2) discloses a multi-layer spray wall core body having a porous sheet between sheets of erected reinforcements. Japanese patent application No. 09347789 published on Jul. 6, 1999 (JP11181989A2) discloses another paper-backed wire lath.

Despite the wide variety of lathing systems that are currently available there remains a need for a lath which avoids the disadvantages discussed above.

SUMMARY OF THE INVENTION

This invention provides a wire lath that can be made to be more rigid than current wire lath products and overcomes a number of disadvantages of expanded metal laths.

Accordingly, one aspect of the invention provides a welded wire lath comprising a plurality of generally parallel transverse wires lying primarily in a first plane. The transverse wires each depart from the first plane in a plurality of spaced-apart bent sections. Each bent section is defined between first and second shoulder portions. While the bent sections can have various shapes, a V-shape is preferred. The bent sections preferably have widths not greater than their heights. The lath also comprises a plurality of generally parallel first longitudinal wires. The first longitudinal wires lie generally in the first plane. They intersect with and are attached, preferably by welding, to the transverse wires. The first longitudinal wires include, for each of the plurality of bent sections, a longitudinal wire attached to each of the transverse wires in at least one of the shoulder portions corresponding to the bent section. The lath also comprises a plurality of generally parallel second longitudinal wires. The second longitudinal wires lie generally in a second plane parallel to and spaced apart from the first plane. The second longitudinal wires are attached to the bent sections of the transverse wires. The second longitudinal wires in conjunction with the bent sections and those first longitudinal wires which are attached at the shoulders of the bent sections form trusses which provide rigidity to the wire lath. The trusses may also serve as furring spacers although separate furring spacers may be provided.

In preferred embodiments of the invention the first longitudinal wires include, for each of the plurality of bent sections, a pair of longitudinal wires. One of the pair of longitudinal wires is attached to each of the transverse wires in a first one of the shoulder portions. The other one of the pair of longitudinal wires is attached to each of the transverse wires in the second one of the shoulder portions.

The wire lath may incorporate a barrier layer disposed between the first and second planes. In preferred embodiments the barrier layer is perforated by elongated transversely-extending apertures and the bent sections pass through the apertures. The barrier layer may comprise a suitable building paper, such as kraft paper, which may be surface treated to improve the adhesion of stucco. The barrier layer may have additional perforations which do not coincide with intersections of the longitudinal wires and transverse wires. The additional perforations serve as "keys" for stucco.

A backing layer, such as a layer of asphalt-coated paper may be adhesively affixed to the barrier layer. In this case the second longitudinal wires extend between the backing layer and the barrier layer.

The wires of a wire lath according to the invention do not need to be round. In some embodiments at least some of the first longitudinal wires are non-round in cross section. The non-round longitudinal wires may advantageously be flattened and oriented to lie generally in the first plane. This provides increased surface area for stucco adhesion, and also can facilitate the application of stucco.

Further features, aspects and advantages of the present invention will be more fully understood when considered with respect to the following detailed description, appended claims, and accompanying drawings.

BRIEF DESCRIPTION OF THE DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
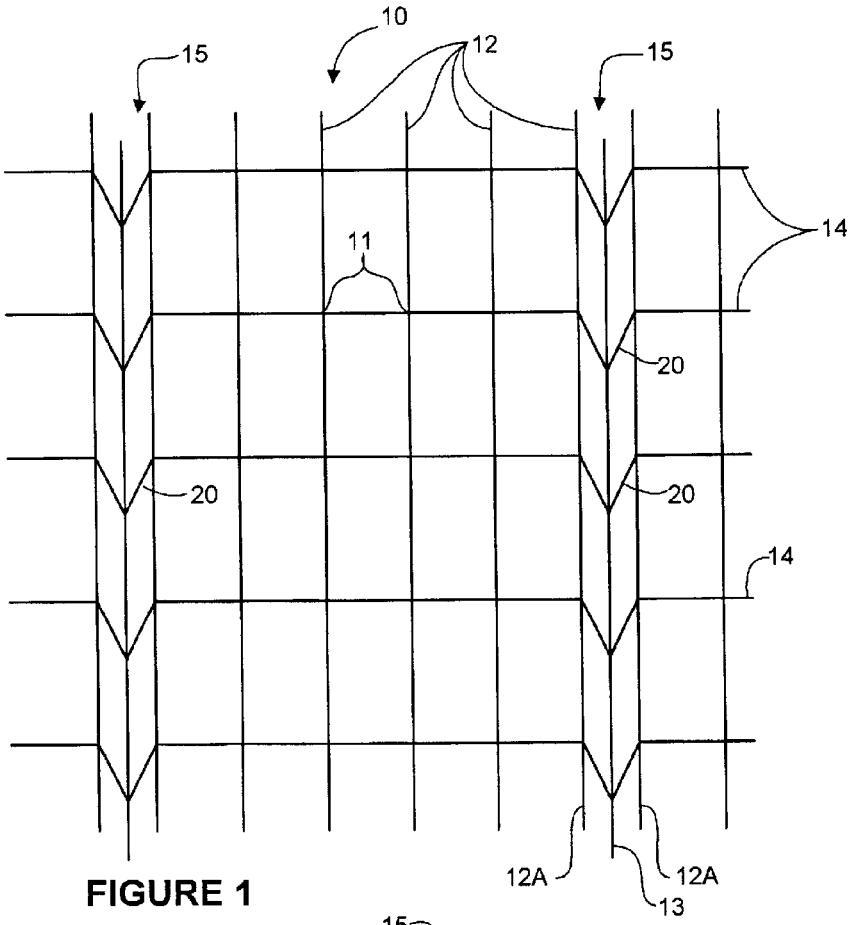
FIG. 1 is a schematic perspective view of a welded wire mesh lath in accordance with the invention.

This invention provides a wire lath in which rigidity is enhanced by the provision of trusses formed in the lath. FIG. 1 shows a lath 10 according to a currently preferred embodiment of the invention. Lath 10 comprises a plurality of first generally parallel longitudinal wires 12 which intersect with a plurality of generally parallel transverse wires 14. Wires 12 and 14 are welded together at their intersections 11. Wires 12 and 14 preferably extend generally perpendicularly to one another. The spacing of wires 12 and 14 can be such that square or rectangular grid openings are created. A set of second longitudinal wires 13 is also welded to transverse wires 14 as described below. Wires 12, 13 and 14 may be made of any suitable materials, such as steel, aluminum, or the like. If made of steel, the wires are preferably galvanized. Wires 12, 13 and 14 are preferably of the same or similar diameters. Preferably wires 12, 13 and 14 have cross sectional areas which differ from one another by 25% or less.

Figure 2:
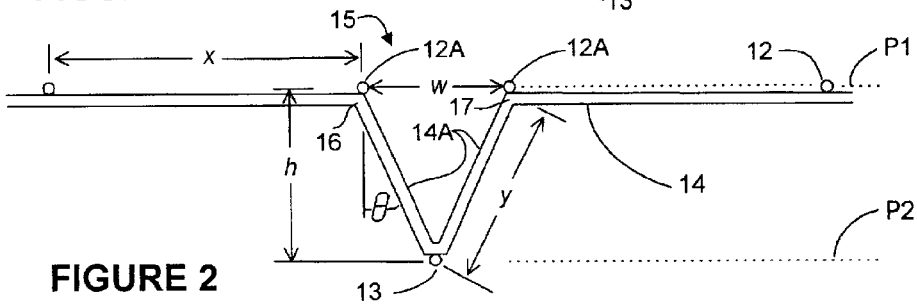
FIG. 2 is a schematic cross-sectional view of the welded wire mesh lath of FIG. 1.

Longitudinally extending trusses 15 are formed at locations spaced-apart across lath 10. Transverse wires 14 have bent sections 20 at the location of each truss 15. In each bent section 20 the transverse wire 14 bends out of plane P1 at a first shoulder 16, extends outwardly at least to plane P2 and then bends back toward plane P1 to the point where it rejoins plane P1 at a second shoulder 17. Longitudinal wires 12 (indicated by the reference 12A) are affixed in a shoulder portion at each of shoulders 16 and 17. Preferably transverse wires 14 bend sharply away from plane P1 at each shoulder 16, 17 with a bend radius of no more than a few diameters of transverse wires 14. Preferably the radii of the bends at shoulders 16 and 17 are less than 5 diameters of transverse wire 14 and most preferably less than 2 diameters of transverse wire 14. In each truss 15, a longitudinal wire 13 of a plurality of second longitudinal wires is affixed to transverse wires 14 on bent sections 20. Bent sections 20 are preferably generally V-shaped, as shown in FIGS. 1 and 2. In preferred embodiments of the invention each transverse wire 14, including bent sections 20, lies in a plane which is generally perpendicular to plane P1.

Longitudinal wires 12A are preferably attached to each transverse wire 14 at a point which is as close as practical to a point at which the transverse wire 14 bends out of plane P1. Longitudinal wires 12A should be attached to transverse wires 14 at points which are spaced away from the points at which transverse wires 14 begin to bend out of plane P1 by no more than about 5–8 times the diameters of transverse wires 14 (and preferably no more than 1–2 times the diameters of transverse wires 14). The term "shoulder region" includes those points which are close to shoulders 16 and 17 (i.e. are spaced away from the points at which transverse wires 14 leave plane P1 by no more than about 8 times the diameter of transverse wires 14).

It can be seen that lath 10 includes longitudinal wires in two groups. A first plurality of generally parallel longitudinal wires 12 (which includes wires 12A and others of wires 12 which are not affixed at bent sections 20) lies generally in a first plane P1 (FIG. 2). A second plurality of generally parallel longitudinal wires 13 are affixed to transverse wires 14 on bent sections 20 and lie generally in a plane P2 which is spaced apart from plane P1 by a distance h. Preferably bent sections 20 of transverse wires 14 bend back toward plane P1 at a distance of approximately h from plane P1 (so that second longitudinal wires 13 are located at the "peaks" of bent sections 13). However, this is not essential. Bent sections 20 could extend away from plane P1 to locations past plane P2 before bending back toward plane P1.

The distance w between the two longitudinal wires 12A on either side of a truss 15 is preferably approximately the same as the depth h of the truss 15. For example, if a truss 15 has a depth of ⅜ inches then the longitudinal wires 12A along its shoulders should be spaced apart from one another by about ⅜ inches. In a preferred embodiment of the invention, the wires 12 in plane P1 are spaced apart by generally equal distances x (see FIG. 2) whereas wires 13 are spaced apart from adjacent wires 12A by a smaller distance y. Preferably y is roughly ½ of x. In another embodiment of the invention x and y are equal. Each truss 15 has at least one longitudinal wire 13 which is displaced out of the plane of the other longitudinal wires 12. Longitudinal wires 12A extend along at least one of the shoulders of truss 15. Preferably each truss 15 includes a pair of longitudinal wires 12A, one attached to transverse wires 14 in the shoulder region on one side of the truss and the other attached to the transverse wires 14 in the shoulder region on the other side of the truss.

It can be seen that trusses 15 enhance the rigidity of lath 10 in the longitudinal direction. Trusses 15 also make lath 10 self-furring. The number and depth of trusses 15 and the thickness of wires 12, 13 and 14 may be selected to achieve a desired strength. Preferably:

The spacing x between longitudinal wires 12 is in the range of about ½ inch to 2 inches;

The spacing between adjacent transverse wires 14 is in the range of about 1 inch to 2 inches;

The spacing between trusses 15 is in the range of about 2 inches to 6 inches.

For soffit lath applications,

The spacing x between longitudinal wires 12 is in the range of about 0.5 to 0.6 inches;

The spacing between adjacent transverse wires 14 is about 1½ inches; and,

The spacing between trusses 15 is about 3 inches.

In an example embodiment, lath 10 has:

nominal spacings of about 0.6 inch between longitudinal wires 12;

nominal spacings of about 1½ inches between transverse wires 14;

wires 12, 13 and 14 formed from 17 gauge (0.051") diameter wire;

trusses 15 having a depth (i.e. the dimension h) of about ⅜ inch; and, trusses 15 spaced apart from one another by about 3 inches.

Lath 10 may be applied over framing members, which are typically 16 inches or 24 inches on center. Lath 10 can be attached to the framing members at the bottom of trusses 15. In horizontal applications, building codes generally require that a lath be attached every 3 inches. In vertical applications, the codes generally require attachment to the framing members every 6 inches. In either case, a 3 inch spacing of the corrugating ribs allows appropriate attachment points. Lath 10 is preferably applied in an orientation such that the side of lath 10 bearing second longitudinal wires 13 faces the framing members, each of the second longitudinal wires crosses a plurality of the framing members, and first longitudinal wires 12 are spaced apart from faces of the framing members by the distance h. The portions of lath 10 between the framing members can be substantially unsupported.

A wire lath 10 can be produced in any desired dimensions but is preferably provided in sheets of widths of sizes that can be easily handled. For example, the sheets may have a width in the range of 2 feet to 5 feet. It can be appreciated that sheets of wire lath 10 can be compactly stacked together with the trusses 15 of one sheet being received within the trusses 15 of the next sheet of wire lath 10 in the stack.

A wire lath 10 may be made by making a sheet of welded wire mesh and then bending transverse wires 14 at predetermined locations to form bent sections 20 such that trusses 15 are formed. Where each truss 15 is formed, a longitudinal wire 13 is displaced out of the plane of the longitudinal wires 12.

It can be appreciated that the provision of trusses 15 can make a lath according to this invention significantly more rigid than prior wire laths. This can be achieved without using jumbo-sized wires which can tend to cause cracking. Further, since trusses 15 are open, stucco is continuous at trusses 15. This is a major advantage over prior ribbed expanded metal laths in which the ribs cannot be fully embedded in stucco.

The wire lath of FIGS. 1 and 2 may be varied in various ways within the scope of the invention. By way of example only, bent sections 20 may have shapes other than V-shaped. For example, bent sections 20 may be U-shaped, trapezoidal, square, generally rectangular, semi-circular, or the like. It is preferable that the sections 14A of transverse wires 14 which extend between each wire 13 and an adjacent wire 12A extend steeply to plane P1. Preferably angle θ is 45 degrees or less. Most preferably angle θ is 30 degrees or less. While it is not as structurally sound, a longitudinal wire 12A could be provided along only one shoulder of each truss 15 instead of along both shoulders, as shown.

More than one longitudinal wire 13 may be provided on each truss 15. If two closely-spaced longitudinal wires 13 are provided on each truss 15 then lath 10 may be fastened to a building structure with fasteners such as nails or screws inserted between the two longitudinal wires 13.

Figure 3:
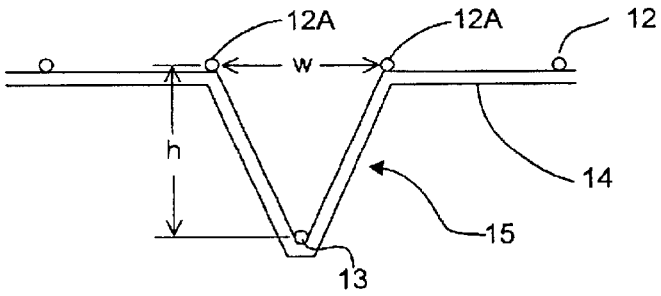
FIG. 3 is a schematic cross-sectional view of a welded wire mesh according to an alternative embodiment of the invention having longitudinal wires in alternative positions.

In the embodiment of FIG. 2, longitudinal wires 13 are on the opposite side of transverse wires 14 from the first longitudinal wires 12. Conversely as shown in FIG. 3, longitudinal wires 13 could also be located on the same side of transverse wires 14 as first longitudinal wires 12. Similarly, all of longitudinal wires 12 and 13 could be on the same side of transverse wires 14 as bent sections 20.

Figure 4:
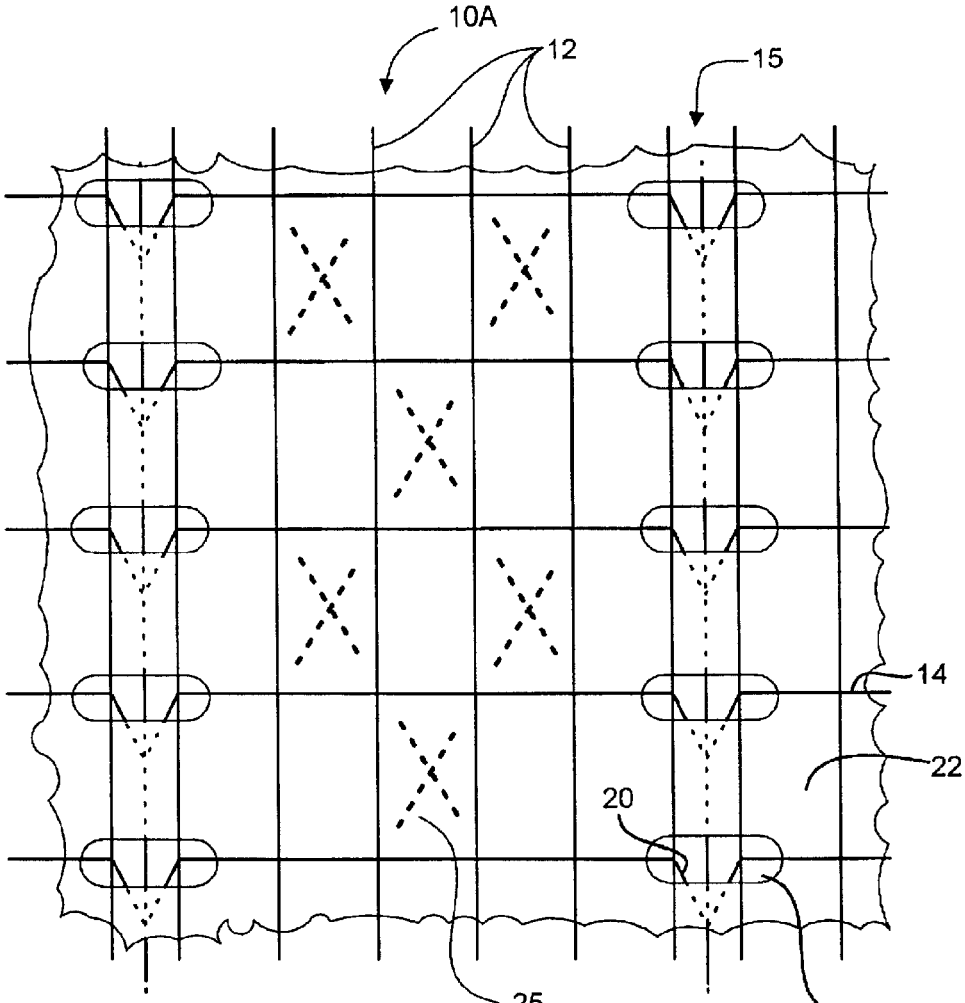
FIG. 4 is a schematic perspective view of a welded wire mesh lath according to the invention which incorporates a separator membrane.
Figure 5:
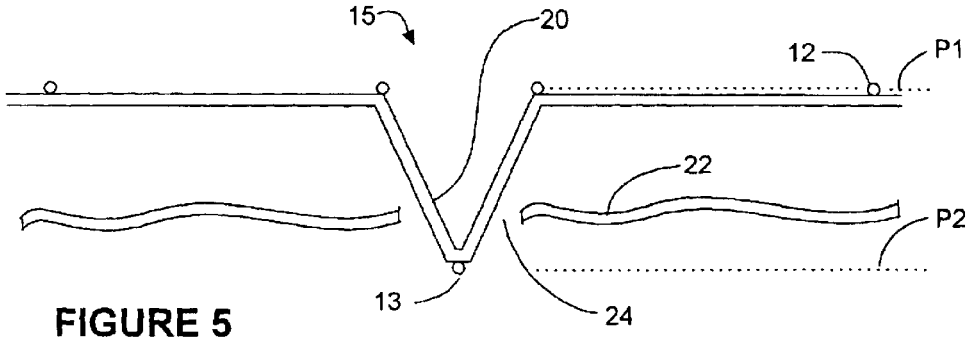
FIG. 5 is a schematic cross-sectional view of the welded wire mesh lath and separator membrane of FIG. 4.

A wire lath according to the invention can include a barrier layer 22, such as a layer of kraft paper, disposed between planes P1 and P2. FIGS. 4 and 5 show a wire lath 10A which includes a barrier layer 22. Apart from the incorporation of layer 22, lath 10A is the same as lath 10. Layer 22 has apertures 24. Bent sections 20 pass through apertures 24. Longitudinal wires 13 are on one side of layer 22 and longitudinal wires 12 are on the other side of layer 22. Barrier layer 22 may comprise a layer of paper. The paper is preferably absorbent and may have a surface treatment such as sanding or microperforation to enhance its adhesion to stucco.

It can be seen that layer 22 does not block stucco from fully embedding longitudinal wires 12 or transverse wires 14. It can further be seen that layer 22 requires relatively few apertures 24. Layer 22 provides protection against blow-through of stucco. Apertures 24 may be elongated to facilitate the currently preferred mode of manufacture of lath 10A. If apertures 24 are elongated then preferably apertures 24 are oriented to be generally parallel to transverse wires 14.

Wire lath 10A may be fabricated by first welding the plurality of first longitudinal wires 12 to transverse wires 14, applying layer 22 and subsequently welding longitudinal wires 13 to bent sections 20 of transverse wires 14. Bent sections 20 may be formed while applying layer 22 and welding longitudinal wires 13 to transverse wires 14. Forming bent sections 20 reduces the width of the sheet of lath 10A. By orienting the apertures 24 parallel to transverse wires 14, the wires of lath 10A can slide sideways without crumpling layer 22. The amount of width reduction will be zero in the center of lath 10A and will increase progressively towards the two outer edges. This can be accommodated by making apertures 24 in the form of elongated slots having lengths which are greater for trusses 15 located toward the outer edges of lath 10A. If bent sections 20 are fully formed before applying layer 22 then apertures 24 do not need to be elongated and could be, for example, round.

Layer 22 may optionally include a series of additional perforations 25. Perforations 25 provide further keying and assist in holding wet stucco to layer 22. Perforations 25 may be extremely small, like the micro-perforations found in dry wall taping materials, or could have larger dimensions up to the mesh grid size. When stucco is being applied, some of the stucco can force its way through perforations 25. The perforations 25 trap some stucco, which will tend to mushroom out on the rear side of layer 22 (i.e. the side of layer 22 toward longitudinal wires 13). The blob of stucco on the rear side of layer 22 locks around the edge of perforation 25 thereby promoting adhesion of the wet stucco to lath 10A. In one embodiment of the invention, perforations 25 comprise slits formed by cutting layer 22 without removing any material. Perforations 25 could be X-shaped, as shown, H-shaped, semi-circular, or some other shape. Perforations 25 could also comprise holes of various shapes in layer 22. For example, the holes could be round, oval, elongated or other shapes.

Figure 6:
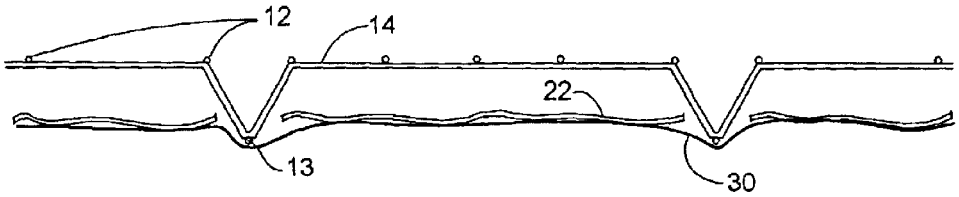
FIG. 6 is a schematic cross-section of a welded wire mesh lath according to the invention incorporating a separator membrane and a backing layer adhesively attached thereto.

As shown in FIG. 6, a wire lath 10B according to another embodiment of the invention has a backing layer 30 of building paper or the like may be applied behind longitudinal wires 13. Layer 30 may be affixed to layer 22 with a suitable adhesive. Layer 30 may comprise, for example, an asphalt-saturated-type building paper or one of the various building wraps. Where a backing layer 30 is provided then perforations 25 in layer 22 are not advantageous.

Figure 7:
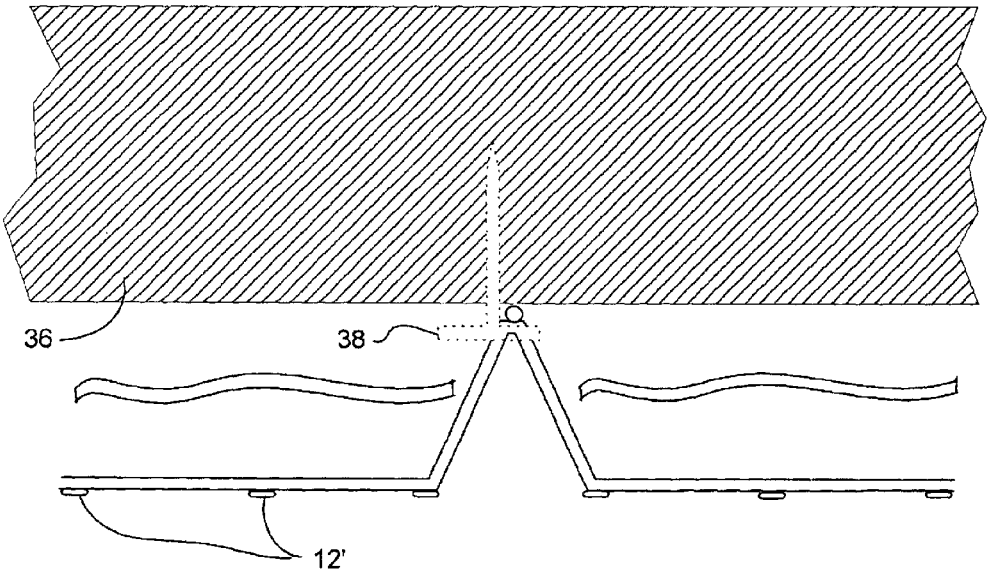
FIG. 7 is a schematic cross-section of a welded wire mesh lath according to the invention incorporating flattened longitudinal wires; and, FIG. 8 is a schematic cross-section of stucco being applied to a welded wire mesh lath comprising concave longitudinal wires.

FIG. 7 shows a wire lath 10C according to another embodiment of the invention. Lath 10C differs from laths 10A and 10B in that longitudinal wires 12 are replaced with shaped wires 12'. Shaped wires 12' have shaped cross sections instead of circular cross-sections. Wires 12' may be, for example, flattened, oval, square, half-round, concave or other non-round formed shapes. Lath 10C has the advantage that the surface areas of wires 12' is increased. This provides enhanced grip when stucco is applied. A further advantage of this embodiment is that the process of shaping longitudinal wires 12' can work-harden wires 12'. This can increase their strength. Thus, a lath using shaped wires 12' may use smaller wire sizes to obtain similar strengths. This, in turn, makes such a lath easier to cut to size, lighter and potentially less costly in materials. The lath of FIG. 7 is shown attached to a transversely-extending stud 36 by way of a nail 38 which captures longitudinal wire 13 against stud 36.

Figure 8:
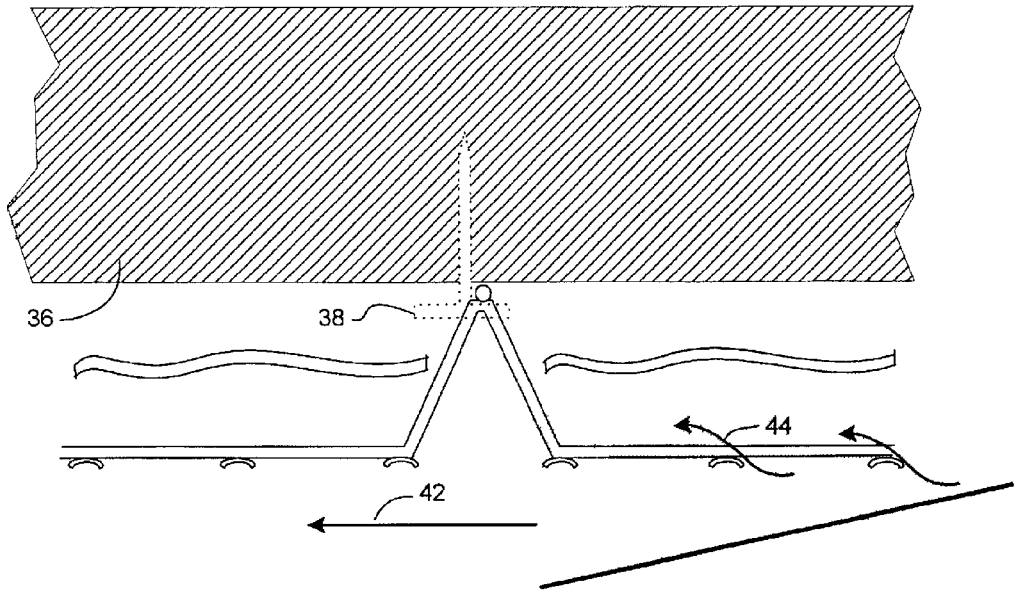

Another advantages of using flattened shaped wires 12' is that appropriately shaped wires can help to direct stucco into lath 12C as it is troweled into place. FIG. 8 illustrates an embodiment of the invention wherein shaped wires 12' are flattened and have their edges curved slightly downwardly. As stucco 40 is troweled across lath 10C, in the direction indicated by arrow 42 shaped wires 12' cut through the flowing stucco and tend to cause part of the stucco to flow upwardly, as indicated by arrows 44.

In the laths described above, trusses 15 play the dual role of providing rigidity and serving as furring spacers. It would be possible to add furring spacers to transverse wires 14 at locations away from trusses 15. The furring spacers may comprise, for example, additional bent sections in transverse wires 14. Where the lath comprises a backing layer 22 the furring spacers pass through apertures in backing layer 22 in substantially the same manner that bent sections 22 pass through apertures 24. The furring spacers provide points for attachment of a lath according to the invention to a building structure and are located away from trusses 15. The use of separate furring spacers thus reduces the risk that trusses 15 may be damaged while a lath is being installed. The furring spacers may be formed, for example, by creating bent sections in transverse wires 14 such that selected ones of longitudinal wires 12 is displaced into or behind plane P2. The lath may then be installed, by attaching the furring spacers to a stud, for example, by nailing, stapling or screwing.

A lath according to any embodiment of the invention may have double relatively closely-spaced longitudinal wires in defined locations. The closely-spaced pairs of wires could, for example, be approximately ⅛ inch apart. This embodiment provides proper attachment when utilizing screws to attach the lath to steel framing. The double wires could be located at the bottoms of the trusses 15 (i.e., wires 13 could be doubled). The double wires could also be at furring locations, and at the two edges of the lath.

As will be apparent to those skilled in the art in the light of the foregoing disclosure, many alterations and modifications are possible in the practice of this invention without departing from the spirit or scope thereof. For example, a lath according to the invention could include additional longitudinal or transverse wires. Accordingly, the scope of the invention is to be construed in accordance with the substance defined by the following claims.

What is claimed is:

1. A welded wire lath comprising:

a) a plurality of generally parallel transverse wires lying primarily in a first plane and each departing from the first plane in a plurality of spaced-apart bent sections, each bent section defined between first and second shoulder regions;

b) a plurality of generally parallel first longitudinal wires lying generally in the first plane and intersecting with and attached to the transverse wires, the first longitudinal wires including, for each of the plurality of bent sections, a pair of longitudinal wires, one of the pair of longitudinal wires attached to each of the transverse wires in a first one of the shoulder regions corresponding to the bent section and another one of the pair of longitudinal wires attached to each of the transverse wires in a second one of the shoulder regions corresponding to the bent section;

c) a plurality of generally parallel second longitudinal wires lying generally in a second plane parallel to and spaced apart from the first plane, the second longitudinal wires attached to the bent sections of the transverse wires, (d) a barrier layer disposed between the first and second planes; and c) a plurality of spaced apart furring spacers on the transverse wires.

2. The wire lath of claim 1 wherein at least some of the first longitudinal wires are non-round in cross-section.

3. The wire lath of claim 2 wherein at least some of the first longitudinal wires are flattened and are oriented to lay generally in the first plane.

* * * * *